US006003499A

United States Patent [19]

Devall et al.

[11] Patent Number: 6,003,499

[45] Date of Patent: Dec. 21, 1999

[54] TANK VENT CONTROL APPARATUS

[75] Inventors: Jeffrey Devall, Liberty; Jon Farmer, Hagerstown; Nancy Amburgey, Connersville, all of Ind.

[73] Assignee: Stant Manufacturing Inc., Connersville, Ind.

[21] Appl. No.: 09/226,678

[22] Filed: Jan. 7, 1999

Related U.S. Application Data

[60] Provisional application No. 60/070,672, Jan. 7, 1998.

[51] Int. Cl.[6] ..... F02M 33/02

[52] U.S. Cl. ..... 123/520; 123/516; 137/588

[58] Field of Search ..... 123/520, 521, 123/519, 518, 516, 198 D; 137/588, 587, 110, 39; 220/86.1, 86.2

[56] References Cited

U.S. PATENT DOCUMENTS

| | | | |
|---|---|---|---|
| 4,392,507 | 7/1983 | Harris . | |
| 5,014,742 | 5/1991 | Covert | 137/588 |
| 5,099,880 | 3/1992 | Szlaga et al. . | |
| 5,234,022 | 8/1993 | Harris . | |
| 5,318,069 | 6/1994 | Harris . | |
| 5,327,934 | 7/1994 | Thompson | 137/588 |
| 5,388,611 | 2/1995 | Harris . | |
| 5,524,662 | 6/1996 | Benjey | 137/587 |
| 5,579,742 | 12/1996 | Yamazaki | 123/520 |
| 5,603,349 | 2/1997 | Harris . | |
| 5,617,832 | 4/1997 | Yamazaki | 123/520 |
| 5,640,993 | 6/1997 | Kasugai | 137/587 |
| 5,669,361 | 9/1997 | Weissinger | 123/520 |
| 5,680,848 | 10/1997 | Katoh | 123/516 |
| 5,697,348 | 12/1997 | Schwager | 123/516 |
| 5,813,434 | 9/1998 | Horiuchi | 137/587 |

*Primary Examiner*—Carl S. Miller
*Attorney, Agent, or Firm*—Barnes & Thornburg

[57] ABSTRACT

An apparatus is provided for controlling venting of vapor to and from a fuel tank. The apparatus includes a housing and first and second valves positioned in the housing. The first valve controls the primary flow of vapors from the fuel tank and includes an aperture permitting an auxiliary flow of vapor to and from the fuel tank. The second valve controls the auxiliary flow of vapor to the fuel tank and includes first and second apertures permitting vapor to flow to the fuel tank. The second valve moves between a first position permitting vapor to flow through the first aperture and a second position permitting vapor to flow through the first and second apertures at a greater flow rate.

29 Claims, 4 Drawing Sheets

TANK VENT CONTROL APPARATUS

This claims priority under 35 U.S.C. § 119(e) to U.S. Provisional Application Ser. No. 60/070,672, filed Jan. 7, 1998, which is expressly incorporated by reference herein.

BACKGROUND AND SUMMARY OF THE INVENTION

The present invention relates to a vehicle fuel tank pressure control apparatus, and particularly to venting apparatus that operates to regulate pressure within a vehicle tank. More particularly, the present invention relates to a tank vent control apparatus that vents fuel vapor from a vehicle fuel tank when fuel is added to the fuel tank and that vents fuel vapor from the vehicle fuel tank under normal running conditions of the vehicle.

During refueling of a vehicle, fuel vapor in the fuel tank is displaced by the incoming fuel and may be discharged from the fuel tank into the atmosphere through the filler neck. To reduce such discharge of fuel vapor, a vapor venting system is often coupled to the fuel tank and configured to permit the fuel vapor in the fuel tank to flow to a vapor-recovery device such as a charcoal canister and to control the timing and flow rate of such fuel vapor from the fuel tank to the vapor-recovery device.

According to the present invention, a fuel vapor vent control apparatus is provided to control venting of fuel vapors from a vehicle fuel tank. The apparatus includes a housing formed to include an inlet, an outlet, and an interior region configured to receive fuel vapor therein through the inlet and discharge fuel vapor therefrom through the outlet. The apparatus further includes a first valve positioned to partition the interior region to form first and second chambers, a first conduit arranged to conduct fuel vapor between the first and second chambers, and a second conduit arranged to conduct fuel vapor between the first and second chambers. The apparatus also includes a second valve positioned to lie in the interior region and arranged to move relative to the first valve to regulate fuel vapor flow through the second conduit.

In preferred embodiments, a primary fuel vapor flow path through the interior region of the housing between the inlet and the outlet is established in the first chamber underneath the first valve to permit fuel vapor to vent through the housing from the fuel tank in communication with the inlet to the vapor-recovery device in communication with the outlet during refueling. The first valve is movable between a closed position blocking the flow of fuel vapor passing through the primary fuel vapor flow path so that it is not discharged through the housing outlet to the vapor-recovery device and an opened position permitting the flow of fuel vapor in the primary fuel vapor flow path to be discharged from the interior region of the housing through the housing outlet to the vapor-recovery device.

The first conduit, second chamber, and second conduit cooperate to establish an auxiliary fuel vapor flow path in the housing to permit fuel vapor to flow between the fuel tank and the vapor-recovery device along a second route whether or not a first route through the primary fuel vapor flow path is opened or closed by the first valve. Fuel vapor flow along the second route through the auxiliary flow path occurs at times when the air pressure in the fuel tank is different than the air pressure in the vapor-recovery device.

The first valve is formed to include the first and second conduits in a preferred embodiment and fuel vapor admitted into the first chamber through the housing inlet can flow through the first conduit and second chamber and past the second valve in the second conduit to reach the housing outlet. The second chamber is located above the first valve.

More and more, states are requiring that vehicle fuel systems be tested periodically to identify systems that do not meet fuel vapor-leakage standards. The tank vent control apparatus with its first and second valves and primary and auxiliary flow paths is adapted to facilitate vehicle fuel system leakage testing.

The second valve is movable relative to the first valve to regulate the flow rate of fuel tank fuel vapor that is discharged from the interior region of the housing through the housing outlet to the vapor-recovery device during, for example, fuel system leakage testing. Specifically, the second valve is positioned to move between a "seated" position engaging a valve seat in the second conduit and on the first valve and permitting a first flow rate of fuel vapor to flow through the auxiliary fuel vapor flow path during normal operation of a vehicle equipped with the tank vent control apparatus and an "unseated" position disengaging the valve seat on the first valve and permitting a second flow rate of fuel vapor to flow through the auxiliary flow path during charging of the fuel system in that vehicle for fuel system leakage testing.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
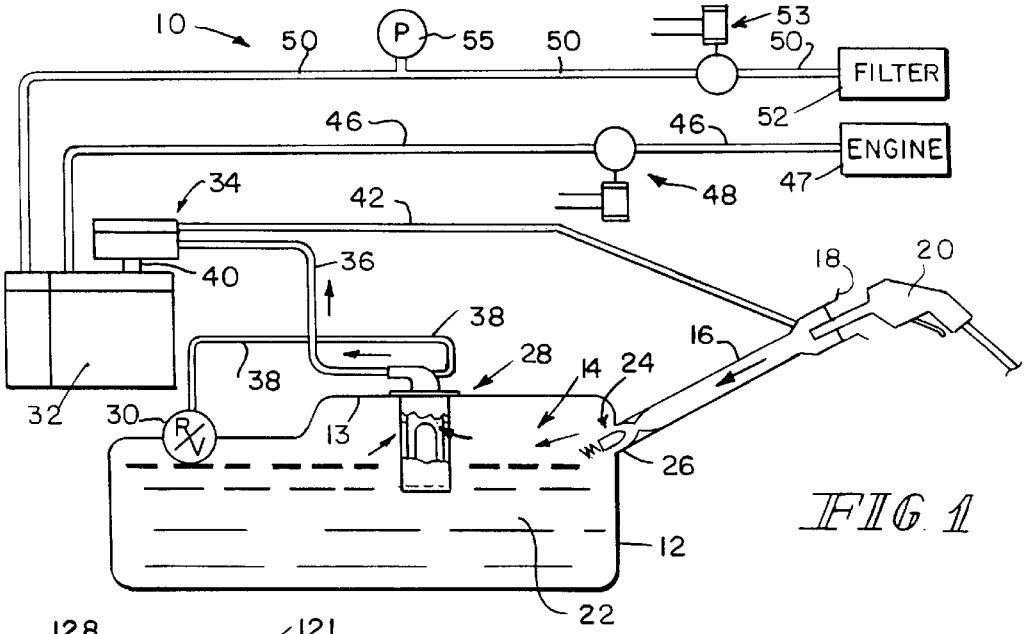
FIG. 1 is a diagrammatic view of a vehicle fuel system showing a vehicle fuel tank, a fuel-dispensing pump nozzle filling the fuel tank through a filler neck, a fill limit valve mounted to a top portion of the fuel tank, and a tank vent control apparatus in accordance with the present invention, the tank vent control apparatus being coupled to each of the fill limit valve, the filler neck, and a vapor-recovery canister of the fuel system through certain fuel system hoses.
Figure 3:
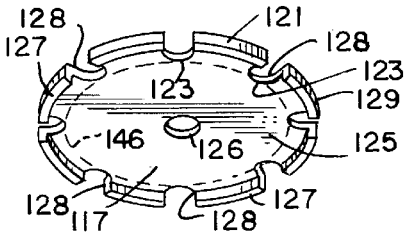
FIG. 3 is a perspective view of the orifice disk of FIG. 2 showing the orifice disk being formed to include a central flow passage arranged to conduct fuel vapor therethrough when the orifice disk is in its seated and unseated positions and a plurality of perimeter flow passages arranged to conduct fuel vapor therethrough only after the orifice disk has been moved to an unseated position as shown, for example, in FIG. 8.

A fuel system 10 includes a fuel tank 12 having an interior region 14 and a filler neck 16 coupled to fuel tank 12 as shown in FIG. 1. Filler neck 16 has an open mouth 18 for receiving a fuel-dispensing pump nozzle 20 during refueling of fuel tank 12. Nozzle 20 is used by a pump operator to introduce liquid fuel 22 into interior region 14 of fuel tank 12. Fuel system 10 includes a torpedo valve 24 situated at a lower end 26 of filler neck 16. Torpedo valve 24 is normally closed but opens during refueling of fuel tank 12.

Fuel system 10 further includes a fill limit valve assembly 28 mounted to a top wall 13 of fuel tank 12. A suitable fill limit valve assembly 28 is disclosed, for example, in U.S. Pat. No. 5,449,029 to Harris, which is hereby incorporated by reference herein.

In addition, fuel system 10 includes a run-loss valve 30 mounted to top wall 13 of fuel tank 12 and a vapor-recovery canister 32 designed to capture and store fuel vapors that are generated in fuel tank 12 and displaced into canister 32. A suitable run-loss valve 30 is disclosed, for example, in U.S. Pat. No. 5,065,782, which is hereby incorporated by reference herein.

A tank vent control apparatus 34 is included in fuel system 10 as shown in FIG. 1. Control apparatus 34 operates to direct fuel vapor from fuel tank 12 to a vapor-recovery device such as canister 32. Control apparatus also operates to facilitate pressurization of fuel tank 12 during a fuel system leakage test. A system for conducting a fuel system leakage test is described in U.S. patent application Ser. No. 09/165,399, entitled On-Vehicle Fuel System Leakage Detector to Robert S. Harris which is hereby incorporated by reference herein. Control apparatus 34 and the operation of control apparatus 34 is described in more detail below with reference to FIGS. 2–7.

Fill limit valve assembly 28 is coupled to control apparatus 34 by a vapor tube 36 so that fuel vapor venting from fuel tank 12 through fill limit valve assembly 28 reaches control apparatus 34. In addition run-loss valve 30 is coupled to vapor tube 36 by a vapor tube 38 so that fuel vapor venting from fuel tank 12 through run-loss valve 30 reaches control apparatus 34. Control apparatus 34 is coupled to canister 32 by a coupling tube 40 as shown in FIG. 1. Control apparatus 34 is also connected in fluid communication to filler neck 16 through a tube 42 to enable control apparatus 34 to "determine" whether a closure cap 44, shown in FIG. 6, that is used to close mouth 18 of filler neck 16 has been removed at the beginning of a refueling cycle and permit fuel vapor to be recirculated from fuel tank 12 to filler neck 16 during refueling. Once closure cap 44 is removed from filler neck 16, atmospheric pressure is communicated to control apparatus 34 through tube 42.

Fuel system 10 includes a vapor line 46 coupled to canister 32 and extending therefrom to an engine 47 through a valve 48, which in preferred embodiments is a solenoid-actuated valve. During normal operation, valve 48 is opened and engine 47 creates suction on line 48 which causes fuel vapor to be drawn out of canister 32 and into engine 47 where the fuel vapor is consumed along with liquid fuel from fuel tank 12.

Fuel system 10 also includes an air supply line 50 through which air from the atmosphere may be drawn into canister 32 after the air passes through a filter 52 when a valve 53 in line 50 is in a first position and through which pressurized air is displaced into canister 32 by a pump 55 when valve 53 is in a second position. In preferred embodiments, valve 53 is a solenoid-actuated valve.

Control apparatus 34 includes a housing 51 having an upper portion 54, a lower portion 56, and a central axis 111, and a diaphragm 58 having an annular perimeter portion 60 which is pinched between upper and lower portions 54, 56, as shown in FIGS. 2–5 and 7. Housing 51 is formed to include an interior region 61 that is partitioned, for example, by diaphragm 58 to define first and second chambers 64, 62. Lower portion 56 is formed to include a vapor-receiving (first) chamber 64 and upper portion 54 of housing 51 is formed to include a vapor-receiving (second) chamber 62.

An upper horizontal tube connector 66 is coupled to upper housing 54 and a passage 68 formed in upper housing 54 fluidly couples region 62 to tube connector 66. Control valve 34 includes a disk 67 situated in tube connector 66 and formed to include a control orifice 69 to control the rate of flow of fuel vapor recirculated to filler neck 16 from fuel tank 12. A lower horizontal tube connector 70 is coupled to lower housing 56 and a passage 72 formed in lower housing 56 fluidly couples region 64 to tube connector 70 to establish an inlet 71 into interior region 61. In addition, a vertical tube connector 74 is appended to lower housing 56 and a passage 76 formed in lower housing 56 fluidly couples region 64 to tube connector 74 to establish an outlet 73 out of interior region 61. Tube 42 couples to tube connector 66, tube 36 couples to tube connector 70, and tube 40 couples to tube connector 74 as shown in FIG. 1.

Figure 4:
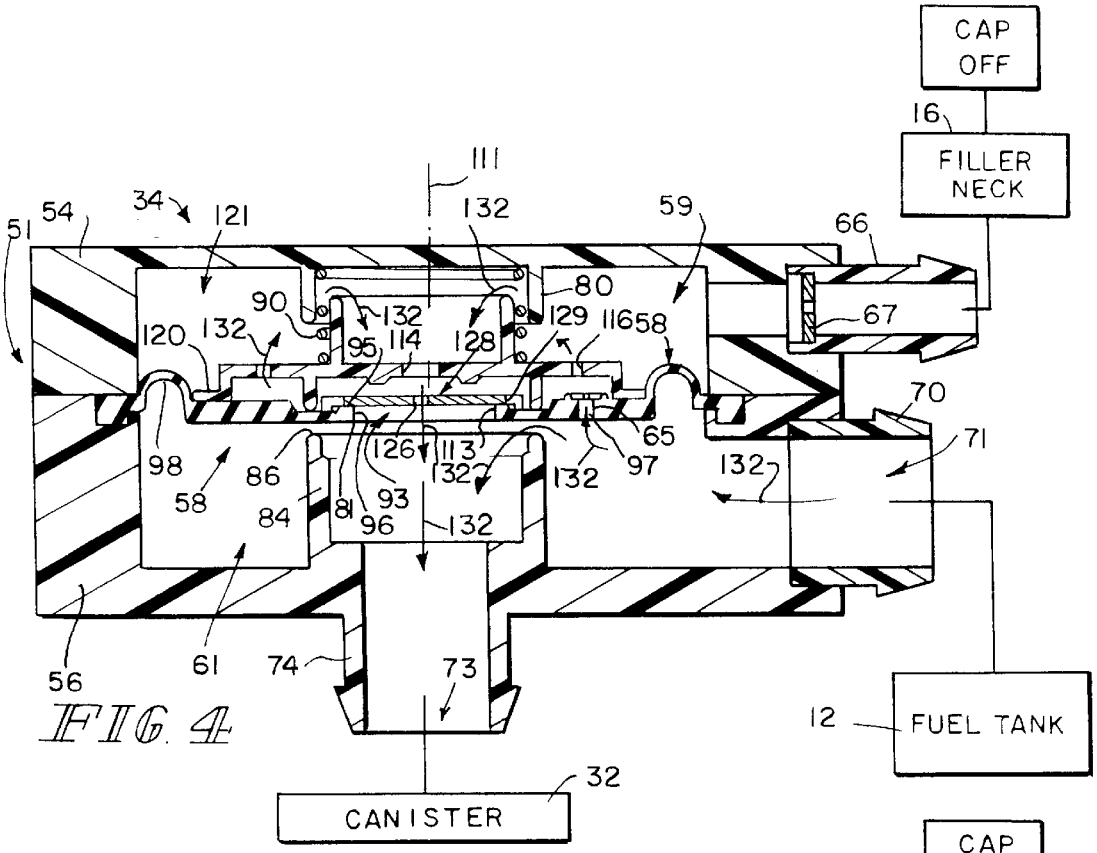
FIG. 4 is a sectional view similar to FIG. 2 just after refueling of the fuel tank showing the spring biasing the backing plate away from the upper housing portion to move the backing plate, diaphragm, and orifice disk downwardly toward the lower housing portion and the outlet formed in the lower housing portion and coupled to the vapor-recovery canister.
Figure 5:
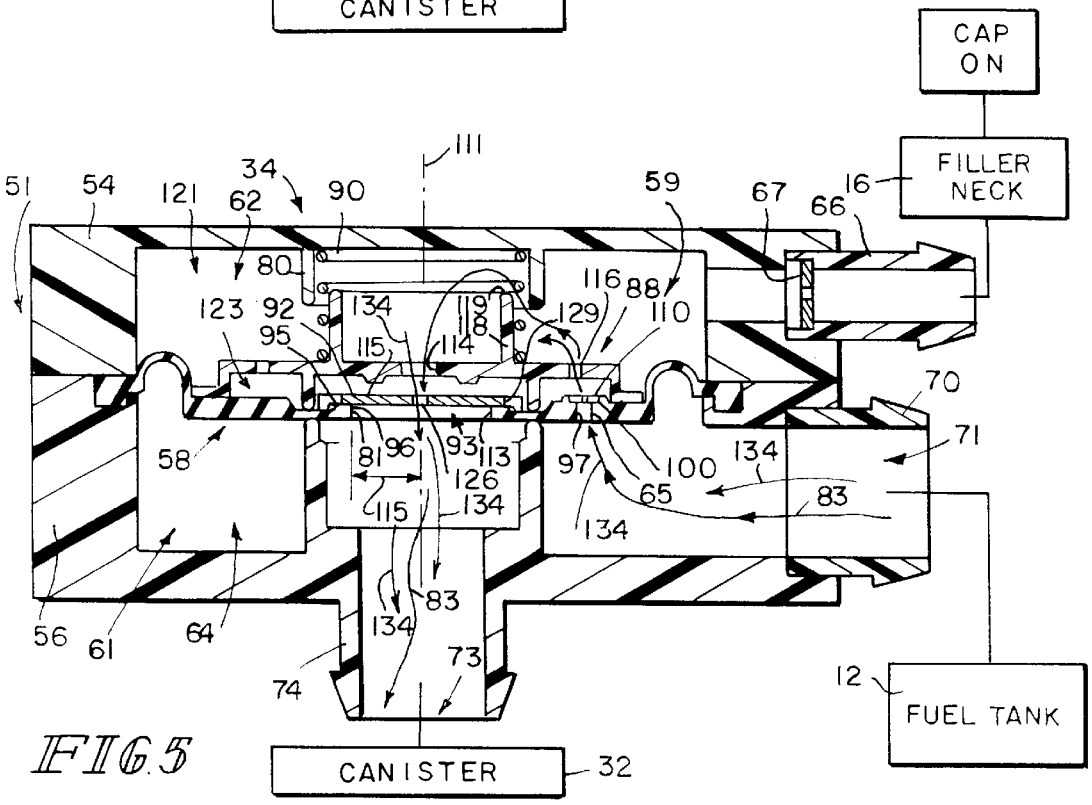
FIG. 5 is a sectional view similar to FIG. 4 showing the vent control apparatus during normal running conditions in which fuel vapor vents from a first chamber formed in the housing below the diaphragm and communicating with the inlet upwardly through a first conduit established by flow passages formed in the diaphragm and the backing plate, into a second chamber formed in the housing above the diaphragm, and then downwardly through a second conduit established by central flow passages formed in the backing plate and diaphragm and through the orifice disk to reach the outlet coupled to the vapor-recovery canister.

Upper housing portion 54 of housing 51 includes a top wall 78 and a cylindrical guide wall 80 extending downwardly from top wall 78 into vapor-receiving chamber 62 as shown in FIGS. 2–5 and 7. Lower portion 56 of housing 51 includes a bottom wall 82 and a cylindrical wall 84 extending upwardly from bottom wall 82 into vapor-receiving chamber 64. Cylindrical wall 84 includes an upwardly facing sealing surface 86 as shown best in FIG. 2. Cylindrical wall 84 provides a valve seat so that sealing surface 86 seals with diaphragm 58 as shown in FIG. 5.

Control apparatus 34 further includes a backing plate 88 positioned to lie between diaphragm 58 and top wall 78 of upper portion 54 of housing 51 to partition vapor-receiving chamber 62 into first and second portions 121, 123, a spring 90 positioned to lie between backing plate 88 and top wall 78 of upper portion 54, and an orifice disk 92 positioned to lie between diaphragm 58 and backing plate 88 as shown in FIGS. 2–5 and 7. Although diaphragm 58 partitions interior region 61 into vapor-receiving chambers 62, 64, it is within the scope of the present disclosure for other structures to partition interior region 61 into vapor-receiving chambers 62, 64. Diaphragm 58, backing plate 88, spring 90 act as a first valve 59 that regulates the flow of fuel vapor between inlet 71 and outlet 73 and orifice disk 92 acts as a second valve 93 that also regulates the flow of fuel vapor between inlet 71 and outlet 73 as described herein.

Figure 2:
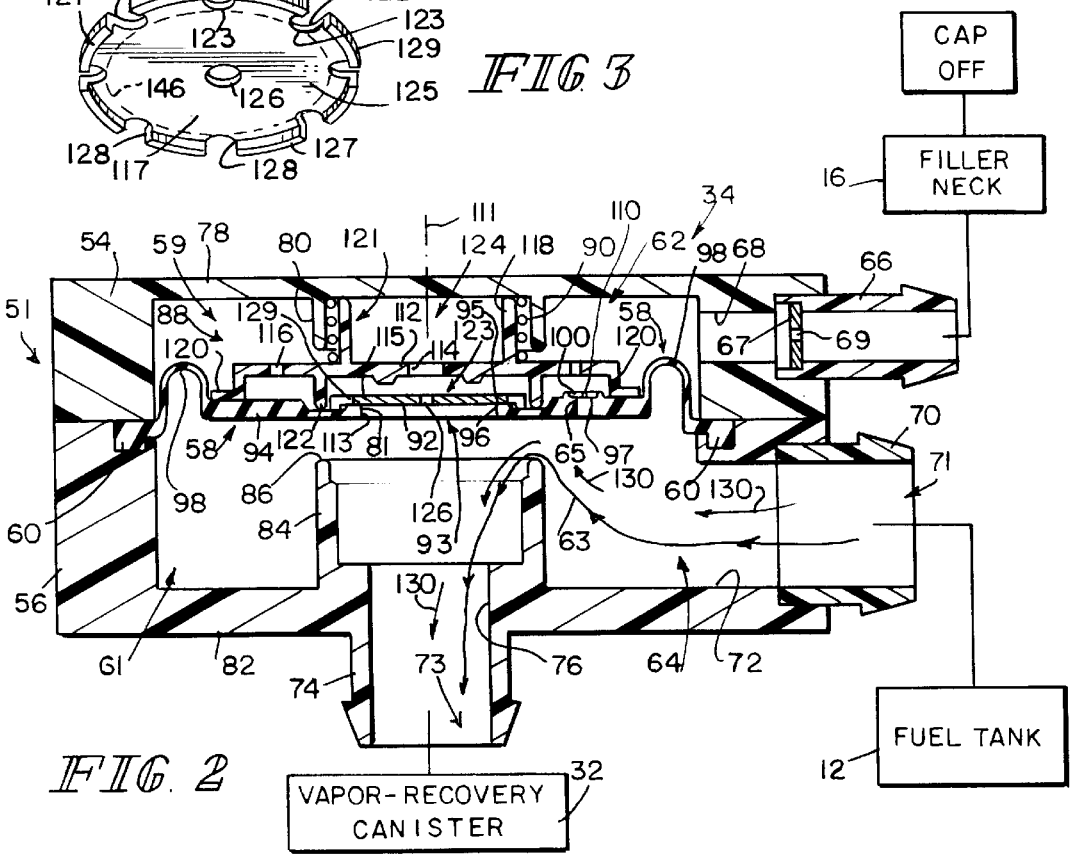
FIG. 2 is a sectional view of the tank vent control apparatus of FIG. 1 during refueling of the fuel tank showing a diaphragm acting as a first valve and having a perimeter portion pinched between upper and lower portions of a housing which cooperate to define an interior region having an inlet coupled to a fuel tank and an outlet coupled to a vapor-recovery canister, a backing plate positioned to lie between the diaphragm and the upper housing portion, a spring positioned to lie between the backing plate and the upper housing, and an orifice disk acting as a second valve and lying in a "seated" position in a space between the backing plate and the diaphragm so that it can be moved to engage and disengage the diaphragm so as to regulate the flow rate of fuel vapor passing through an aperture formed in the diaphragm and arranged to communicate with the housing outlet, and showing the diaphragm after it has been moved upwardly away from the outlet formed in the lower housing portion to allow a large quantity of fuel vapor to vent from the fuel tank to the vapor-recovery canister.

Diaphragm 58 includes a somewhat rigid disk-shaped body 94 including an interior surface 113 defining a central flow passage 96 extending along central axis and a bleed-flow passage 97. Bleed-flow passage 97 cooperates to establish a first conduit 65 between vapor-receiving chambers 62, 64 to permit communication of fuel vapor therebetween. Although first conduit 65 is formed in diaphragm 58, it is within the scope of the present disclosure to form first conduit 65 in other locations such as in housing 51 or coupled to housing 51. Interior surface 113 is spaced apart from central axis 111 by distance 115 as shown in FIG. 5. A small disk 100 with a control orifice 110 formed therein is coupled to diaphragm 58 and covers bleed-flow passage 97 as shown in FIG. 2. Diaphragm 58 also includes a flexible portion 98 that interconnects body 94 with annular perimeter portion 60 and a radial wall 95 that defines a valve seat 129 that seals with orifice disk 92. Flexible portion 98 has a somewhat U-shaped cross section.

Backing plate 88 includes a disk portion 112 that is formed to include a central flow passage 114 and a plurality of bleed-flow passages 116. Central flow passage 96 of diaphragm 58, central flow passage 114 of back plate 88, and the space therebetween cooperate to establish a second conduit 81 between vapor-receiving chambers 62, 64 to permit communication of fuel vapor therebetween. Backing plate 88 also includes a cylindrical wall 118 extending upwardly from disk portion 112. Cylindrical wall 112 includes an upwardly-facing stop surface 119. Backing plate 88 includes an outer perimeter rim 120 appended to the outer perimeter of disk portion 112 and extending downwardly therefrom. Rim 120 has an L-shaped cross section. Backing plate 88 further includes a cylindrical wall 122 extending downwardly therefrom. Cylindrical wall 122 has a diameter that is substantially equivalent to the diameter of top guide wall 80 and cylindrical wall 84.

Spring 90 is a coiled compression spring having an interior region 124. An upper portion of spring 90 is situated inside of guide wall 80 and cylindrical wall 118 is situated inside interior region 124 of spring 90. Spring 90 is maintained in a state of compression between top wall 78 and backing plate 88 so as to bias backing plate 88, diaphragm 58, and orifice disk 92 toward lower housing 56. Orifice disk 92 is formed to include a central flow passage 126 and a plurality of circumferentially spaced-apart, perimeter flow perimetral flow passages 128 as shown best, for example, in FIG. 3.

Orifice disk 92 acts as a second valve 93 and includes a round body 125 and a radial wall 127 coupled to round body 125 that extends downwardly along central axis 111. Round body 125 includes a top surface 115, a bottom surface 117 facing away from top surface 115, and a perimeter edge 129. Flow passage 126 extends through orifice disk 92 along central axis 111 as shown in FIG. 4 and perimeter flow passages 128 are spaced apart from central axis 111. Perimeter edge 129 includes a radial portion 121 and detent portions 123 defining perimeter flow passage 128. It is within the scope of the present disclosure for other configurations of flow passages to be formed in orifice disk 92. For example, flow passage 126 may be formed to include multiple apertures of various shapes and sizes. Perimeter flow passage 128 may be defined by one or more complete apertures, slots, or other voids of various shapes and sizes.

Control apparatus 34 is shown during refueling of fuel tank 12 in FIG. 2. During refueling, a large volume of liquid fuel 22 is introduced into interior region 14 of fuel tank 12 which displaces a large quantity of fuel vapor into vapor-receiving region 64 of lower housing 56. Receipt of the large quantity of fuel vapor in region 64 produces pressure sufficient to cause diaphragm 58 to move upwardly away from sealing surface 86 of cylindrical wall 84. As diaphragm 58 moves upwardly, backing plate 88 moves upwardly and compresses spring 90 until stop surface 119 of cylindrical wall 118 engages top wall 78 of upper housing 54. After diaphragm 58 moves upwardly away from sealing surface 86, the large quantity of fuel vapor is able to vent from tube connector 70 to tube connector 74 through vapor-receiving chamber 64 between diaphragm 58 and sealing surface 86 as indicated by arrows 130 of FIG. 2.

Thus, vapor-receiving chamber 64 establishes a primary fuel vapor flow path 63 between inlet 71 and outlet 73 through which a large volume of fuel vapor is communicated from fuel tank 12 to canister 32. Furthermore, diaphragm 58, backing plate 88, and spring 90 act as first valve 59 to control the flow of fuel vapor through primary flow path 63 by moving from a closed position, as shown in FIG. 5, blocking the flow of fuel vapor through primary fuel vapor flow path 63 to an opened position, as shown in FIG. 2, permitting the flow of fuel vapor through primary fuel vapor flow path 63.

Control valve 34 is shown in FIG. 4 just after refueling of fuel tank 12 in which spring 90 moves backing plate 88, diaphragm 58, and orifice disk 92 downwardly toward cylindrical wall 84 of lower housing 56. After refueling a much smaller quantity of fuel vapor reaches valve 34 than during refueling. The reduction in fuel vapor quantity reaching valve 34 results in a reduced pressure in region 64 and spring 90 is able to overcome the reduced pressure to move backing plate 88, diaphragm 58, and orifice disk 92 from the position shown in FIG. 2, through the position shown in FIG. 4, to the position shown in FIG. 5. As backing plate 88, diaphragm 58, and orifice disk 92 move in this manner, some fuel vapor flows between diaphragm 58 and sealing surface 86 and some fuel vapor flows through flow passages 96, 97, 110, 114, and 126 to reach tube connector 74 as indicated by arrows 132 of FIG. 4.

Control apparatus 34 is shown in FIG. 5 during normal running conditions in which fuel vapor vents from tube connector 70 upwardly through flow passage 97 formed in diaphragm 58, flow passage 110 formed in disk 100, and passages 116 formed in backing plate 88; into interior region 124 of spring 90; and then downwardly through flow passage 114 formed in backing plate 88, flow passage 126 formed in orifice disk 92, and flow passage 96 formed in diaphragm 58 to reach the tube connector 74 as indicated by arrows 134 of FIG. 5. Spring 90 biases diaphragm 58 against sealing surface 86 of cylindrical wall 84 during normal running conditions. In addition, gravity biases orifice disk 92 downwardly to rest upon diaphragm 58 during refueling, as shown in FIG. 2, and during normal running conditions as shown in FIG. 5.

First conduit 65 established by flow passage 97 communicates fuel vapor between vapor-receiving chambers 62, 64. Second conduit 81 established by central flow passage 96 of diaphragm 58 and central flow passage 114 of backing plate 88 communicates fuel vapor between vapor-receiving chambers 62, 64. Thus, conduit 65, flow passage 116, flow passage 126, and conduit 81 establish a first auxiliary flow path 83 through vapor-receiving chambers 62,64 between inlet 71 to outlet 73. Fuel vapor is permitted to flow through first auxiliary flow path 83 at a first flow rate from inlet 71 to outlet 73 even though first valve 59 is in the closed position.

Figure 6:
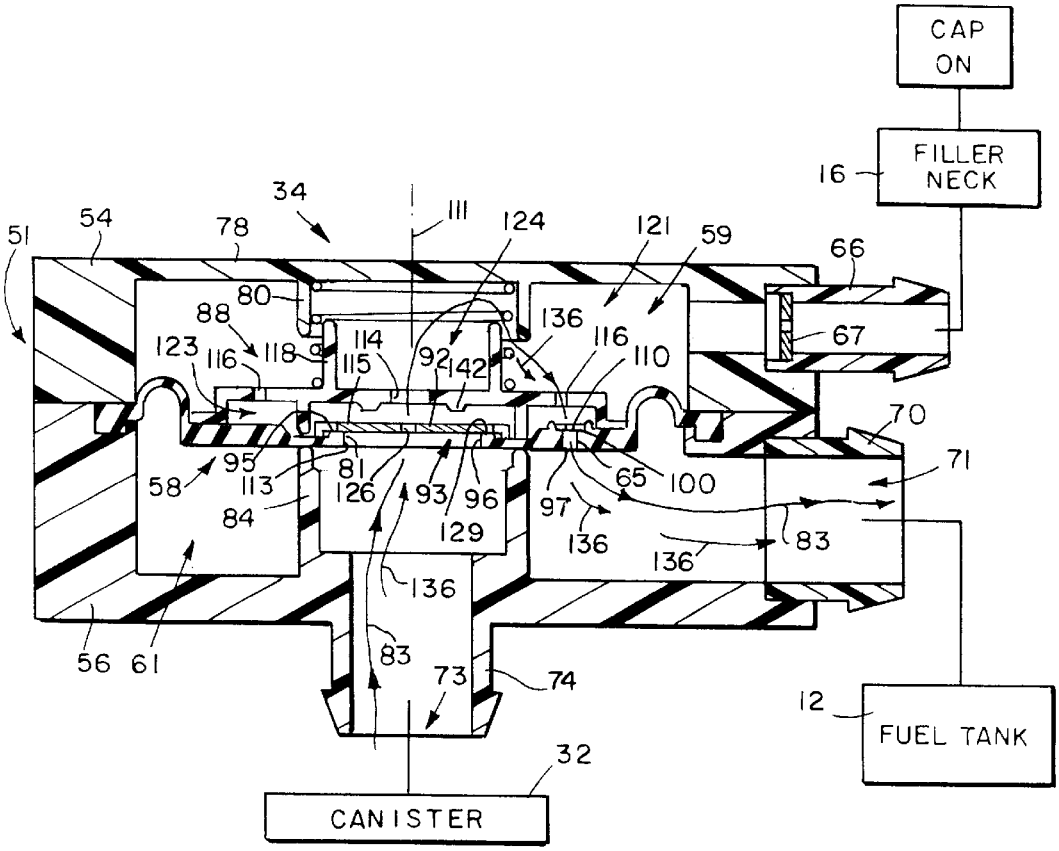
FIG. 6 is a sectional view similar to FIG. 5 showing the tank vent control apparatus during fuel tank sub-atmospheric conditions in which air and/or fuel vapor vents from the canister upwardly through the housing outlet, the second conduit, and orifice disk, and then downwardly through the first conduit housing inlet coupled to the fill-limit valve mounted in the top wall of the fuel tank for admission into the fuel tank.

When fuel tank 12 and the fuel 22 therein cools, pressures that are sub-atmospheric may be created in interior region 14 of fuel tank 12. Control apparatus 34 is shown in FIG. 6 during fuel tank sub-atmospheric conditions in which fuel vapor vents from canister 32 upwardly through tube connector 74, second conduit 81, and flow passage 126 formed in orifice disk 92; into interior region 124 of spring 90; and then downwardly through flow passage 116 formed in backing plate 88, and first conduit 65 to reach tube connector 70 as indicated by arrows 136 of FIG. 6. Thus, fuel vapor is permitted to flow through first auxiliary flow path 83 from outlet 73 to inlet 71 even though first valve 59 is in the closed position.

Figure 7:
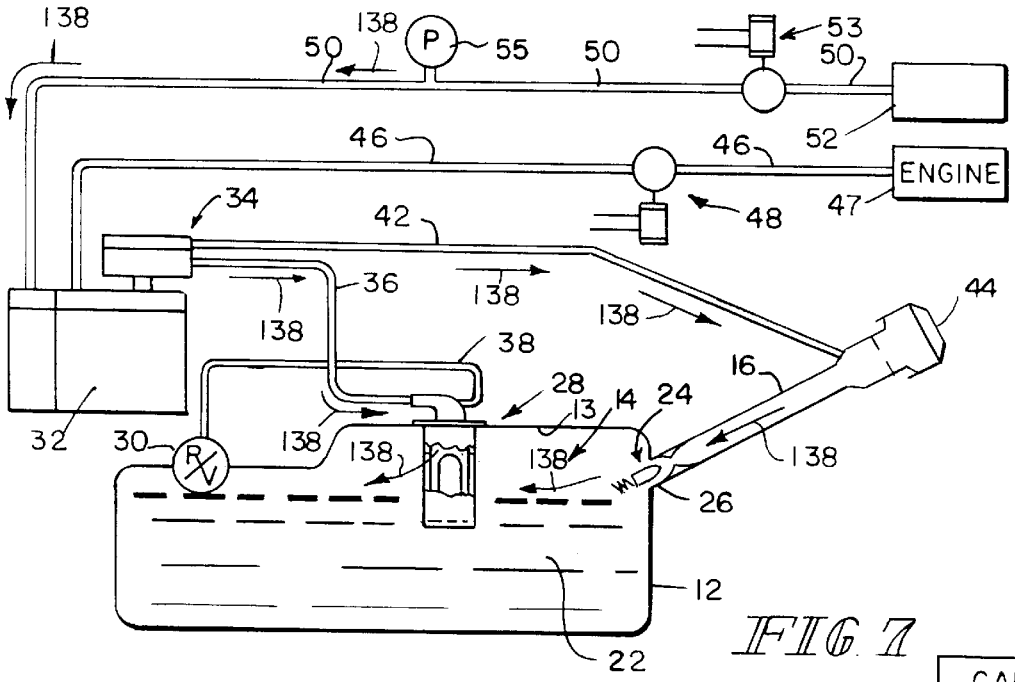
FIG. 7 is a diagrammatic view of the fuel system of FIG. 1 during an onboard fuel system leakage test in which the fuel tank is deliberately pressurized by a pump showing a fuel cap closing the filler neck and the pump pressurizing the fuel tank through the canister and through the tank vent control apparatus of FIG. 2.

Fuel system 10 includes pump 55 and valves 48, 53 as previously described. An on-board fuel system leakage test may be performed to test the leakage integrity of fuel system 10. During the leakage test, valve 48 is closed to isolate fuel system 10 from engine 47, valve 53 is closed to isolate fuel system 10 from the atmosphere, and pump 55 is operated to pressurize fuel system 10. During the onboard fuel system leakage test, as shown in FIG. 7, fuel tank 10 is deliberately pressurized by pump 55 along two paths indicated by arrows 138 while fuel cap 44 closes filler neck 16.

Figure 8:
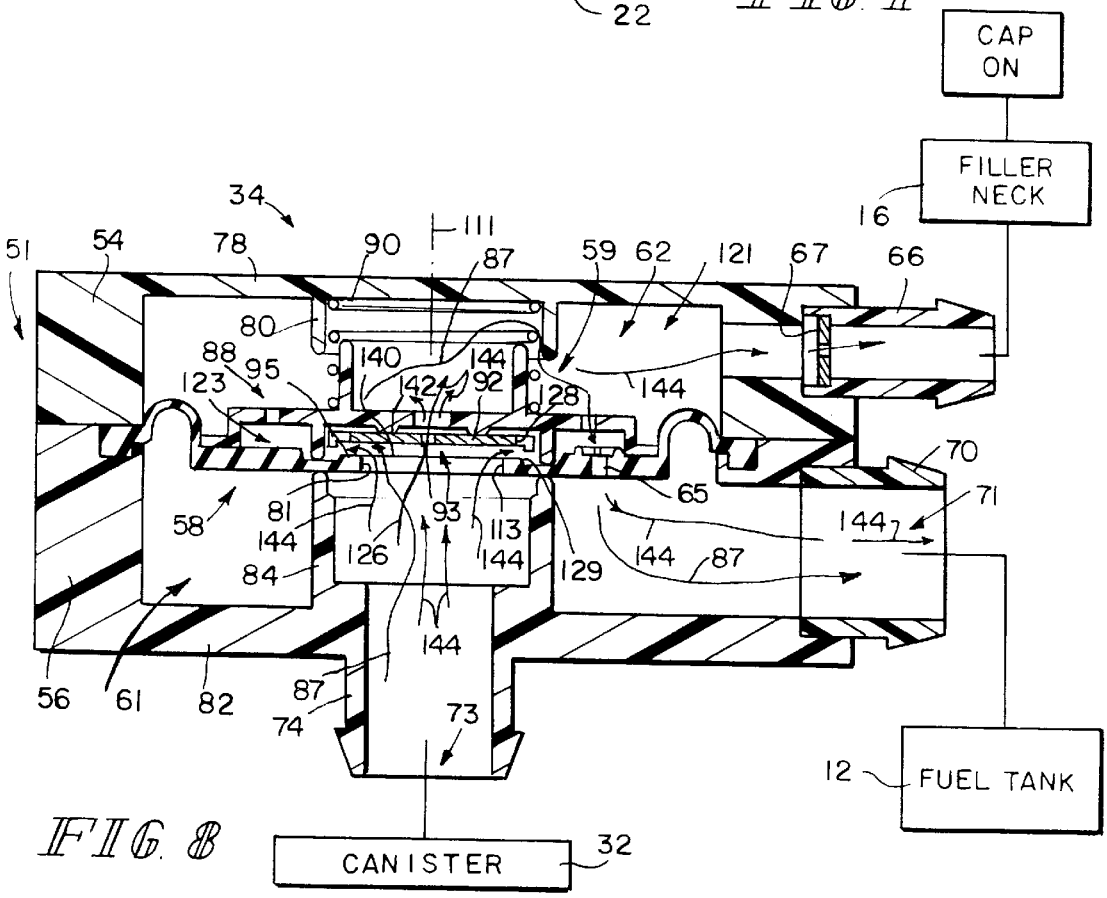
FIG. 8 is a sectional view of the tank vent control apparatus of FIG. 2 during the on-board fuel system leakage test showing the orifice disk after it has been moved upwardly away from a sealing surface of the diaphragm to an unseated position in contact with spacer pads appended to the backing plate to allow pressurized air from the pump to move upwardly through the central flow passage formed in the orifice disk and also through perimeter flow passages formed at a perimeter of the orifice disk.

Control apparatus 34 is shown in FIG. 8 during the on-board fuel system leakage test in which orifice disk 92 acts as second valve 93 and moves upwardly away from a sealing surface 140 of diaphragm 58 to an unseated position in contact with a set of spacer pads 142 of backing plate 88 to allow pressurized air generated by pump 55 to move upwardly through second conduit 81, aperture 126 formed in orifice disk 92 and through flow passages 128 formed in orifice disk 92; into interior region 124 of spring 90; and then either downwardly through flow passages 116 formed in backing plate 88, and flow passage 97 formed in diaphragm 58 to reach tube connector 70 or horizontally through interior region 62 to reach tube connector 66 as indicated by arrows 144 of FIG. 8. Thus, perimeter flow passages 128 cooperate with flow passage 126 to allow a larger volume of pressurized air to move past orifice plate 92 when orifice plate 92 is lifted off of diaphragm 58 than when orifice plate 92 is resting upon diaphragm 58 because valve seat 95 of diaphragm 58 seals against orifice plate 92 along dotted line 146, shown in FIG. 3, when orifice plate 92 rests upon valve seat 95 of diaphragm 92.

Thus, perimeter flow passages 128 provide an additional flow path through orifice disk 92 so that conduit 81, flow passages 126, 128, flow passage 116, and conduit 65 provide a second auxiliary flow path 87 through vapor-receiving chambers 62, 64 between outlet 73 and inlet 71. Flow passage 126 establishes a first flow area through first auxiliary flow path 83. Flow passage 126 cooperates with flow passage 128 to establish a second flow area that is greater than the first flow area.

Thus, orifice disk 92 acts as second valve 93 to control the flow of fuel vapor through second auxiliary flow path 87. Second valve 93 moves between a closed position, shown in FIGS. 2–6, blocking the flow of fuel vapor through flow passage 128 and an opened position, shown in FIG. 8, permitting the flow of fuel vapor through flow passage 128.

Although the invention has been described in detail with reference to certain preferred embodiments, variations and modifications exist within the scope and spirit of the invention as described and defined in the following claims.

We claim:

1. An apparatus for controlling venting of fuel vapors from a vehicle fuel tank, the apparatus comprising a housing formed to include an inlet adapted to receive fuel vapor from a vehicle fuel tank, an outlet, and an interior region configured to communicate with the inlet and outlet, a first valve positioned to partition the interior region to form a first chamber establishing a primary flow path between the inlet and the outlet and a second chamber, the first valve being movable between a closed position blocking the flow of vapor through the primary flow path from the inlet to the outlet and an opened position permitting the flow of vapor through the primary flow path from the inlet to the outlet, the first valve being formed to include a first flow passage arranged to conduct vapor between the first and second chambers, a conduit arranged to conduct vapor between the first and second chambers, and a second valve positioned to lie in the interior region to move from a seated position to an unseated position, the second valve being formed to include a second flow passage and a third flow passage, the conduit, the second chamber, the second flow passage, and the first flow passage cooperating to establish a first auxiliary flow path while the second valve is in the seated position, the second flow passage establishing a first flow area through the first auxiliary flow path while the second valve is in the seated position, the conduit, the second chamber, the second flow passage, the third flow passage, and the first flow passage cooperating to establish a second auxiliary flow path while the second valve is in the opened position, the second and third flow passages cooperating to establish a second flow area through the second auxiliary flow path while the second valve is in the opened position, the second flow area being greater than the first flow area.

2. The apparatus of claim 1, wherein the housing is formed to include a filler neck passage adapted to communicate fuel vapor from the interior region of the housing to a vehicle filler neck.

3. The apparatus of claim 2, wherein the filler neck passage is coupled to the second chamber.

4. The apparatus of claim 2, further comprising a control orifice positioned to lie in the passage formed in the housing.

5. The apparatus of claim 1, wherein the first valve is a diaphragm partitioning the interior region into the first and second chambers.

6. The apparatus of claim 5, wherein the diaphragm is formed to include the first flow passage.

7. The apparatus of claim 5, wherein the diaphragm includes a body and a valve seat coupled to the body to block the flow of fuel vapor through the third flow passage while the second valve is in the closed position.

8. The apparatus of claim 1, wherein the first valve includes a diaphragm and a spring, the diaphragm partitions the interior region into the first and second chambers and blocks the flow of fuel vapor through the primary flow path while the first valve is in the closed position, and the spring is arranged to bias the diaphragm to the closed position.

9. The apparatus of claim 8, wherein the housing is formed to include a guide wall arranged to support the spring.

10. The apparatus of claim 8, wherein the first valve further includes a backing plate positioned to lie between the spring and the diaphragm.

11. An apparatus for controlling venting of fuel vapors from a vehicle fuel tank, the apparatus comprising a housing formed to include an inlet adapted to receive fuel vapor from a vehicle fuel tank, an outlet, and an interior region configured to communicate with the inlet and outlet, a first valve positioned to partition the interior region to form a first chamber establishing a primary flow path between the inlet and the outlet and a second chamber, the first valve being movable between a closed position blocking the flow of vapor through the primary flow path from the inlet to the outlet and an opened position permitting the flow of vapor through the primary flow path from the inlet to the outlet, a first conduit arranged to conduct vapor between the inlet and the second chamber, a second conduit arranged to conduct vapor between the second chamber and the outlet, and a second valve positioned to lie in the interior region to move from a seated position to an unseated position, the second valve being formed to include a first flow passage and a second flow passage, the first conduit, the second chamber, the first flow passage, and the second conduit cooperating to establish a first auxiliary flow path while the second valve is in the seated position, the first flow passage establishing a first flow area through the first auxiliary flow path while the second valve is in the seated position, the first conduit, the second chamber, the first flow passage, the second flow passage, and the second conduit cooperating to establish a second auxiliary flow path while the second valve is in the opened position, the first and second flow passages cooperating to establish a second flow area through the second auxiliary flow path while the second valve is in the opened position.

12. The apparatus of claim 11, wherein the first valve is formed to include the first and second conduits.

13. The apparatus of claim 12, wherein the first valve includes a diaphragm arranged in the interior region to partition the interior region to define the first and second chambers and a backing plate positioned in the second chamber, first apertures formed in the diaphragm and the backing plate and aligned to confront one another cooperate to establish openings into the first conduit, second apertures formed in the diaphragm and the backing plate and aligned to confront one another cooperate to establish openings into the second conduit.

14. The apparatus of claim 13, wherein the second valve is positioned to lie in the second conduit in a position between the second aperture formed in the diaphragm and the second aperture formed in the backing plate to engage the diaphragm upon movement of the second valve to its seated position.

15. The apparatus of claim 11, wherein the first conduit is formed in the first valve.

16. The apparatus of claim 11, wherein the second conduit is formed in the first valve.

17. The apparatus of claim 16, wherein the first valve includes a central axis and the second conduit extends between the second chamber and outlet along the central axis.

18. The apparatus of claim 16, wherein the second conduit extends along an axis and is defined by an interior surface spaced apart from the axis by a first distance, and the second flow passage is positioned to lie at a second distance from the axis that is greater than the first distance.

19. The apparatus of claim 16, wherein the second conduit establishes a flow area that is greater than the second flow area of the second valve.

20. An apparatus for controlling venting of fuel vapors from a vehicle fuel tank, the apparatus comprising a housing formed to include an inlet adapted to receive fuel vapor from a vehicle fuel tank, an outlet, and an interior region configured to communicate with the inlet and outlet, a valve including a diaphragm and a backing plate, the diaphragm being positioned to partition the interior region to form a first chamber to establish a primary flow path between the inlet and the outlet and a second chamber, the diaphragm being movable between a closed position blocking the flow of fuel vapor through the primary flow path from the inlet to the outlet and an opened position permitting the flow of fuel vapor through the primary flow path from the inlet to the outlet, the backing plate being positioned to partition the second chamber into a first portion positioned to lie between the backing plate and the diaphragm and a second portion positioned to lie between the backing plate and the housing, the diaphragm being formed to include first flow passage arranged to conduct vapor between the outlet and the first portion of the second chamber, the backing plate being formed to include a second flow passage arranged to conduct vapor between the first and second portions of the second chamber, a conduit arranged to conduct vapor between the first and second chambers, the conduit, the second portion of the second chamber, the first portion of the second chamber, and the first flow chamber cooperating to form an auxiliary flow path, and a disk positioned to lie in the first portion of the second chamber to move between a closed position and an opened position, the disk being formed to include a third flow passage and a fourth flow passage, the third flow passage establishing a first flow area through the first portion of the second chamber while the disk is in the closed position to permit vapor to flow through the auxiliary flow path, the third and fourth flow passages cooperating to establish a second flow area through the first portion of the second chamber while the disk is in the opened position, the second flow area being greater than the first flow area.

21. The apparatus of claim 20, wherein the disk has a central axis and the third flow passage is positioned to extends through the disk along the central axis.

22. The apparatus of claim 21, wherein the fourth passage is spaced apart from the central axis.

23. The apparatus of claim 20, wherein the disk is round.

24. The apparatus of claim 20, wherein the disk includes a top surface, a bottom surface facing away from the top surface, and a perimeter edge, the perimeter edge includes a radial portion and a detent portion defining the fourth passage.

25. The apparatus of claim 24, wherein the perimeter edge includes a plurality of radial portions and a plurality of detent portions defining a plurality of detents establishing the fourth passage.

26. The apparatus of claim 20, wherein the disk is formed to include a plurality of apertures establishing the fourth passage.

27. The apparatus of claim 20, wherein the disk has a central axis and includes a body and a radial wall coupled to the body and extending away from the body portion along the central axis.

28. The apparatus of claim 27, wherein the diaphragm includes a body and a radial wall coupled to the body and extending away from the body of the diaphragm along the central axis, the radial wall of the disk is spaced apart from the central axis by a first distance, and the radial wall of the diaphragm is spaced apart from the central axis by a second distance that is less than the first distance.

29. The apparatus of claim 27, wherein the disk is formed to include a detent that interrupts the radial wall to establish the fourth passage.

* * * * *